US005100613A

United States Patent [19]

Bodnar et al.

[11] Patent Number: 5,100,613

[45] Date of Patent: Mar. 31, 1992

[54] HOT-ROLLED MICROALLOYED STEEL AND ITS USE IN VARIABLE-THICKNESS SECTIONS

[75] Inventors: Richard L. Bodnar; Steven S. Hansen, both of Bethlehem, Pa.

[73] Assignee: Bethlehem Steel Co., Bethlehem, Pa.

[21] Appl. No.: 598,283

[22] Filed: Oct. 16, 1990

[51] Int. Cl.[5] ..... C22C 38/12

[52] U.S. Cl. ..... 420/120; 420/127; 420/128; 148/320

[58] Field of Search ..... 420/120, 127, 128; 148/320

[56] References Cited

FOREIGN PATENT DOCUMENTS 2055771 6/1971 Fed. Rep. of Germany ..... 420/120

582318 11/1977 U.S.S.R. ..... 148/320

*Primary Examiner*—Deborah Yee

*Attorney, Agent, or Firm*—Gregory Germong; John Iverson

[57] ABSTRACT

A vanadium-nitrogen microalloyed steel is continuously hot rolled to C-shaped sections that meet property requirements for side rails of truck frames with no heat treatment. Sections with different thicknesses of the web and flange regions can also be prepared by the same processing. The composition of the steel is from about 0.16 to about 0.20 percent carbon, from about 1.2 to about 2.0 percent manganese, from about 0.45 to about 0.55 percent silicon, from about 0.10 to about 0.30 percent vanadium, from about 0.001 to about 0.030 percent aluminum, from about 0.010 to about 0.027 percent nitrogen, less than about 0.030 percent phosphorus, less than about 0.030 percent sulfur, balance iron totalling 100 percent, with all percentages by weight. Variations of this steel containing either from about 0.01 to about 0.02 percent titanium or 0.04 to about 0.07 percent aluminum are also permissible.

18 Claims, 2 Drawing Sheets

HOT-ROLLED MICROALLOYED STEEL AND ITS USE IN VARIABLE-THICKNESS SECTIONS

BACKGROUND OF THE INVENTION

This invention relates to steel alloys, and, more particularly, to a microalloyed steel that can be hot rolled to reduced sections with a good combination of strength, toughness, and other properties such as fatigue strength.

In the most common approach, the frames of large trucks are constructed from side rails made of steel, which are joined to each other with cross members. The engine, drive train, suspension, and cargo container are then supported on the frame. The assembly must be extremely rugged and capable of operating without failure for extended years of use and in extreme environmental conditions.

The side rails are conventionally made of hot-rolled band material such as a Si-semikilled, modified 1027 steel that is uncoiled, sheared, and cold formed into a structural section of uniform thickness, such as a C-section or channel. Depending upon the steel alloy employed, the as-formed section may be used without further heat treatment, or it may be heat treated to realize the full potential of the mechanical properties.

The manufacturers of truck frames have developed or are developing specifications to be met by the steel alloys used in the side rails. The specifications usually involve standards for mechanical properties such as yield strength, ultimate tensile strength, notch toughness transition temperature, and/or fatigue strength. The supplier of the steel must provide a steel that meets the specifications at as low a cost of production as possible, in order to be competitive.

There have generally been two approaches to meeting the specifications currently set for side rails by major truck manufacturers. In one, a steel having a relatively small amount of alloying additions is hot rolled, cold formed, and heat treated. In the other, a steel having more alloying additions is hot rolled and cold formed, with no heat treatment required because the alloying additions produce sufficiently good mechanical properties in this condition that the standards are met without heat treatment. The heat-treated steels typically have higher strength and toughness levels than the as-rolled alloyed steels, but the heat treatment raises the cost of the final product.

A possible future development is the use of side rails that are not of uniform thickness. Specifically, the flanges (sides) would have a greater thickness than the web that connects the flanges. Variable thickness sections would provide an increased section modulus, and thence increased payload (or, alternatively, decreased weight and fuel consumption), and reduced vehicle size. Such a variable-thickness section would be hot rolled, and, with today's steels, heat treated in an attempt to achieve the required mechanical properties. As indicated, the heat treatment would substantially increase the product cost, negating some of the advantages that would otherwise be achieved.

There is a need for a steel that meets the requirements of truck manufacturers at as low a production cost as possible. Such a steel would desirably be suitable for forming hot rolled sections of variable thickness and meeting property requirements without heat treating.

The present invention fulfills this need, and further provides related advantages.

SUMMARY

The present invention provides a steel, and process for the preparation of steel products therefrom, that achieves an excellent combination of strength and toughness properties. These properties are achieved by developing the section shape and required properties directly through hot rolling, thereby eliminating the need for cold forming and subsequent heat treatment. These properties can be achieved over a range of practical hot-rolled final sections of interest, up to about 0.7 inches in thickness, permitting sections of differing thicknesses to be prepared. Final products such as channel sections can be designed with flanges differing in thickness from the web, to save weight while maintaining section modulus. The steel is a high strength, low alloy steel having a relatively low content of alloying elements, and there is no cold forming or heat treating required to achieve the required shape and properties, respectively. The production cost of finished parts is therefore reduced as compared with prior steels which require cold forming and/or heat treating.

In accordance with one embodiment of the invention, a steel consists essentially of from about 0.16 to about 0.20 percent carbon, from about 1.2 to about 2.0 percent manganese, from about 0.45 to about 0.55 percent silicon, from about 0.10 to about 0.30 percent vanadium, from about 0.001 to about 0.030 percent aluminum, from about 0.010 to about 0.027 percent nitrogen, less than about 0.030 percent phosphorus, less than about 0.030 percent sulfur, balance iron, with all percentages by weight. In a preferred composition, the steel contains from about 1.5 to about 1.7 percent manganese, from about 0.18 to about 0.22 percent vanadium, or about 0.023 to about 0.027 percent nitrogen. Most preferably, the steel contains about 0.18 percent carbon, about 1.6 percent manganese, about 0.50 percent silicon, about 0.20 percent vanadium, about 0.020 percent aluminum, about 0.025 percent nitrogen, about 0.020 percent phosphorus, and about 0.025 percent sulfur.

In a titanium-containing variation of these compositions, the sulfur content is less than about 0.005 percent and the steel also contains from about 0.010 to about 0.020 percent titanium.

In another embodiment, a steel consists essentially of from about 0.16 to about 0.20 percent carbon, from about 1.2 to about 2.0 percent manganese, from about 0.45 to about 0.55 percent silicon, from about 0.10 to about 0.30 percent vanadium, from about 0.040 to about 0.070 percent aluminum, from about 0.010 to about 0.027 percent nitrogen, less than about 0.030 percent phosphorus, less than about 0.030 percent sulfur, balance iron, with all percentages by weight. A preferred composition has from about 1.5 to about 1.7 percent manganese, from about 0.18 to about 0.22 percent vanadium, and from about 0.023 to about 0.027 percent nitrogen. A most preferred composition contains about 0.18 percent carbon, about 1.6 percent manganese, about 0.50 percent silicon, about 0.20 percent vanadium, about 0.055 percent aluminum, about 0.025 percent nitrogen, about 0.020 percent phosphorus, and about 0.025 percent sulfur.

These steels may be processed to structural sections by reheating the steel to the hot rolling range, preferably about 2100° F. but as high as about 2300° F., and then rolling the steel to sections in a sequence of hot rolling passes. Sections having variable section thicknesses of up to at least about 0.7 inches thickness can be prepared. No cold forming or heat treating such as austenitizing, quenching, and tempering is required to achieve acceptable properties.

Although the steels differ somewhat in composition, they are all silicon-aluminum fully killed steels that are strengthened in part by vanadium-nitrogen precipitates. The carbon content is adjusted to control the fraction of pearlite in the final product, at a level which provides some strengthening but does not reduce notch toughness below an acceptable value. Titanium or aluminum can be added to increase toughness (accompanied by a slight but acceptable loss in strength).

The steels of the invention are suitable for preparing channel sections such as used in truck frame rails. The controlled composition allows for low variability of properties with thickness, permitting sections of variable thickness to be hot rolled. Controlled rolling, which involves delays or intermediate cooling to achieve the desired temperature reduction schedule, is not required, making the present steel much more economical to produce than steels requiring controlled rolling practices. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

The preferred steel of the invention has from about 0.16 to about 0.20 percent carbon, from about 1.5 to about 1.7 percent manganese, from about 0.45 to about 0.55 percent silicon, from about 0.18 to about 0.22 percent vanadium, from about 0.001 to about 0.030 percent aluminum, from about 0.023 to about 0.027 percent nitrogen, less than about 0.030 percent phosphorus, less than about 0.030 percent sulfur, balance iron totalling 100 percent, with all percentages by weight. Within this range, a most preferred composition contains about 0.18 percent carbon, about 1.6 percent manganese, about 0.50 percent silicon, about 0.20 percent vanadium, about 0.020 percent aluminum, about 0.025 percent nitrogen, about 0.020 percent phosphorus, and about 0.025 percent sulfur. (All compositions herein are presented in percent by weight, unless stated otherwise.)

Figure 1A:
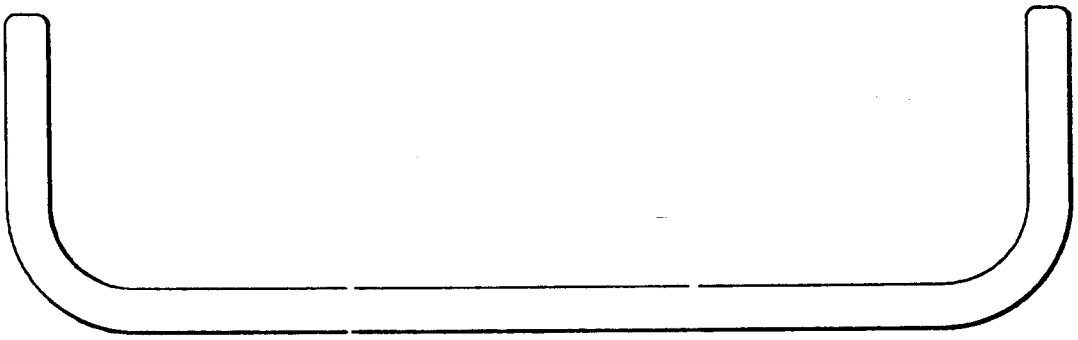
FIG. 1 is a sectional view of three C-sections that have been hot rolled by the approach of the invention, including section 1A wherein the web thickness is the same as the flange thickness, and FIG. 1B and 1C wherein the web thickness is less than the flange thickness.
Figure 1B:
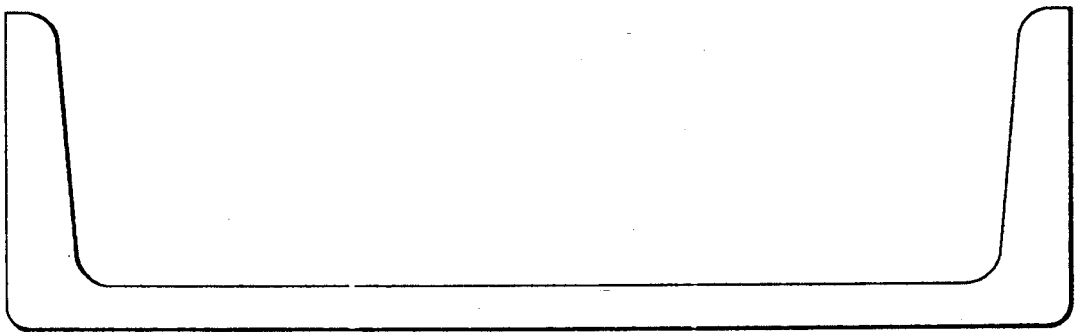
Figure 1C:
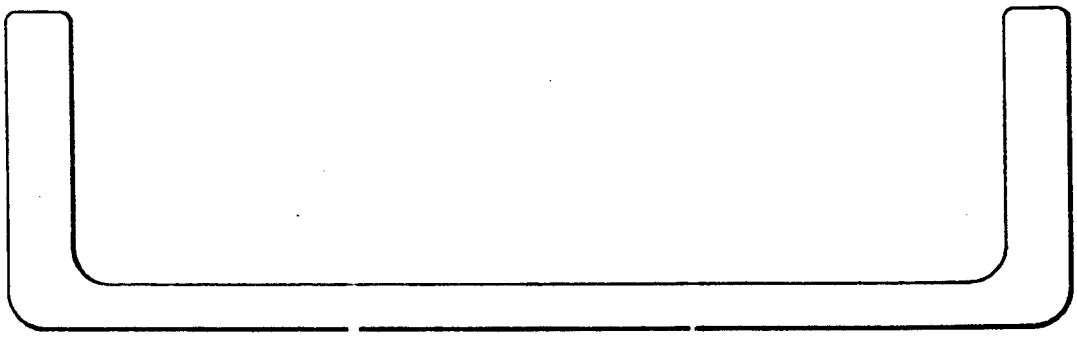

The steel of the invention is prepared on a commercial scale by conventional steelmaking practice, such as in a basic oxygen furnace. The steel is ingot cast or continuously cast (except that the titanium-containing steel should always be continuously cast). The cast steel is reheated in a conventional gas-fired furnace, preferably to a temperature of about 2100° F. but alternatively to higher temperatures. The steel is rolled (or otherwise worked) using conventional hot rolling practice to its final shape and dimensions at temperatures in the hot rolling range, generally greater than one-half the absolute melting point of the steel. No subsequent cold forming or heat treatment is required or recommended. The hot rolling reduction can finish with passes that define sections such as C-shaped or channel sections, having the flange thickness the same as, or different from, the web thickness. Examples of such sections are shown in FIG. 1.

The alloying elements and their percentages in the alloys are carefully selected to achieve particular combinations of properties. In one application of particular interest, C-sections for truck frames, the steel must meet industry and customer standards. To meet the standards, the steel section must have an ambient temperature yield strength of at least 87,000 pounds per square inch (psi) and a Charpy V-notch toughness of at least 20 foot-pounds at +32° F., and should have a 15 foot-pound Charpy V-notch ductile-to-brittle transition temperature below commonly experienced ambient temperatures.

The steel of the invention meets these requirements, by careful selection of the composition of the steel and its processing. The selection and amounts of the alloying elements are interdependent, and cannot be optimized without regard to the other elements present and their amounts. Within the context of the entirety of the composition of the steel, the alloying elements and their percentages are selected for the reasons set forth in the following paragraphs.

The carbon content ranges from about 0.16 to about 0.20 percent. Carbon forms isolated carbides that contribute to strengthening and also reacts with iron to form pearlite. Increasing amounts of carbon raise the strength but also lower the toughness of the steel. In the present steel, if the carbon content is less than about 0.16 percent, the yield strength of the alloy is unacceptably low and does not meet the yield strength requirement. If the carbon content is greater than about 0.20 percent, the pearlite content is too high and the toughness is unacceptably low.

The manganese content ranges from about 1.5 to about 1.7 percent. Manganese contributes to hardenability of the steel, solid solution strengthening, and avoidance of hot shortness by reacting with and removing elemental sulfur from the steel. Manganese also affects the ferrite transformation temperature, which in turn affects the fineness of the microstructure including the ferrite grain size and the pearlite interlamellar spacing. The reduction of microstructural size is an important contributor to the strength and toughness of the steel, since the fine ferrite grain size and fine pearlite both result in improved strength and toughness. The manganese content of the present steel is greater than in most steels, to ensure a low ferrite transformation temperature in the absence of high levels of more expensive alloying elements such as nickel or chromium. Furthermore, if the manganese content is below the indicated range, the ferrite transformation temperature is not sufficiently suppressed to achieve strength and toughness goals. If the manganese content is too low, it is not possible to achieve uniform strength in sections of different thickness, or in different regions of the same section. If the manganese content is higher than the indicated range, there is a tendency toward microstructural banding, particularly when the steel is cast in a continuous casting machine. In addition, excessive manganese content can promote the formation of lower transformation products such as bainite or martensite phases, whose presence can have a negative effect on both yield strength and toughness.

The present steel is a fully killed steel, which exhibits improved toughness as compared with a semi-killed steel. A fully killed steel has an elemental oxygen content below about 100 parts per million, and preferably below about 40 parts per million. A fully killed steel can be achieved either through chemical reaction of the oxygen dissolved in the molten steel, typically with silicon and aluminum to produce their respective oxides, or by removing the oxygen via a vacuum treatment. The use of vacuum deoxidation is not preferred for the present steel, as the steel is a high-volume product whose cost would be increased significantly by the use of a vacuum deoxidation operation. Chemical deoxidation is therefore preferred.

For the preferred, less expensive, chemical deoxidation practice, both aluminum and silicon are employed to produce a fully killed steel. Furthermore, silicon in solution strengthens the ferrite phase. However, excessive amounts of silicon above about 0.55 weight percent can be embrittling, potentially leading to difficulties in both casting and rolling.

The aluminum content must be at least about 0.001 percent, and preferably is at least about 0.010 percent, to ensure the final level of deoxidation and the desired internal quality of the steel (that is, removal of dissolved oxygen). The aluminum content should not exceed about 0.03 percent in this first embodiment, as the strong nitride forming capacity of the aluminum tends to reduce the nitrogen available for the formation of vanadium nitrides, one of the primary particulate strengtheners in the microstructure.

The permissible maximum aluminum content is determined in conjunction with a consideration of the available nitrogen. As will be discussed later, the maximum nitrogen content of the steel is about 0.027 percent. At this nitrogen content, and assuming a reheat temperature of 2100° F. prior to hot rolling and an aluminum content of 0.03 percent, about 0.017 percent nitrogen remains in solution after the formation of aluminum nitride, and is therefore available to combine with vanadium to produce fine vanadium nitride precipitates during air cooling after rolling. For an aluminum content of about 0.01 percent, virtually all of the nitrogen remains in solution to form vanadium nitride, again assuming a reheat temperature of 2100° F. At the minimum nitrogen level of 0.023 percent, about 0.015 percent nitrogen remains in solution at 2100° F. where the aluminum content is 0.03 percent; virtually all of the nitrogen remains in solution where the aluminum content is 0.01 percent. (Nitrogen solubility data are from the publication of Irvine, Pickering, and Gladman, "Grain Refined C-Mn Steels," *J. Iron and Steel Institute*, vol. 205, p. 161 (1967).)

It is concluded that these soluble nitrogen levels are sufficient for the formation of enough vanadium nitride for strengthening purposes. Thus, the allowable maximum aluminum content of about 0.03 percent is closely tied both to deoxidation, and to the vanadium nitride strengthening mechanism and the need to have sufficient available nitrogen content after reheating for operation of this mechanism. The preferred aluminum content is about 0.02 percent, to maximize the strengthening due to the vanadium nitride particulate, while achieving a fully killed steel.

Vanadium is present to provide vanadium nitride strengthening precipitates. If the vanadium content is below about 0.18 percent, there is insufficient strengthening to achieve the desired yield strength, here 87,000 psi. If the vanadium is increased above about 0.22 percent, the strengthening effect saturates and no further increase is found because all of the available nitrogen is reacted and no further vanadium nitride can form. Further increases in vanadium are highly uneconomical, as the cost of vanadium is high. The preferred vanadium content is about 0.20 percent.

Since vanadium combines with nitrogen to form the vanadium nitride precipitates, sufficient nitrogen must be present to form enough fine precipitates to achieve the required yield strength levels. At a reheating temperature of 2100° F., all vanadium and the nitrogen not reacted with the aluminum are in solution. To provide nitrogen for aluminum nitride formation at high temperature, and leave available nitrogen in solution for later combination with vanadium at low temperature, the nitrogen content must be at least about 0.023 percent. Lesser amounts result in insufficient yield strength in the final product due to an insufficient number of fine vanadium nitride precipitates. The nitrogen content cannot exceed about 0.027 percent, because such levels are not readily achievable using conventional steelmaking practices.

The manganese and vanadium contents indicated previously are selected to meet the strength and toughness requirements indicated previously. If the requirements were modified for less strength and more toughness, the manganese content could be reduced to as low as about 1.20 percent, the vanadium content reduced to as low as about 0.10 percent, and the nitrogen content reduced to as low as about 0.010 percent. On the other hand, if the strength requirement was raised and the toughness requirement lowered, then the manganese content could be raised to as much as 2.00 percent and the vanadium content to as much as 0.30 percent.

Phosphorus remains in solution at ambient temperature and strengthens the ferrite by solid solution strengthening. A level of less than 0.030 percent phosphorus is easily achievable in production.

The sulfur content of the steel is maintained below about 0.030 percent. Sulfur reacts with manganese to form manganese sulfides, and one reason for the high manganese content of the steel is to ensure that the free sulfur is fully reacted to manganese sulfides. The manganese sulfides can act as crack initiation sites which reduce the toughness of steel. The sulfur content can be reduced, well below 0.005 percent and as low as 0.002 percent, using special steelmaking practices. If the sulfur content could be economically reduced to this level, that would be acceptable. However, such special practices are costly, and to maintain the cost of the steel low they are not used in the preferred approach. The tendency to reduced toughness caused by the high level of manganese sulfide inclusions is acceptable in light of toughness contributions made by the various toughness-enhancing mechanisms, and in light of the cost to achieve low sulfur contents.

In the second embodiment of the invention, the sulfur level is reduced to 0.005 percent maximum, preferably about 0.002 percent. Titanium in an amount of from 0.010 to about 0.020 percent, preferably about 0.015 percent, is added. The steel of the second embodiment is preferably prepared by continuous casting, to permit formation of fine titanium nitride (TiN) particles. These fine titanium nitride particles restrict austenite grain growth at the reheat temperature and during hot rolling. As a result, a finer austenite grain size is produced after rolling which transforms to a finer ferrite grain size; this finer ferrite grain size provides an increment in both strength and toughness. However, during hot rolling vanadium nitride (VN) can precipitate on or combine with the TiN precipitates, thus reducing the amount of vanadium and nitrogen available for the precipitation of VN strengthening precipitates subsequent to finish hot rolling. If the titanium level is in excess of about 0.020 percent, the amount of nitrogen available for vanadium nitride precipitation is dramatically reduced. On the other hand, at least about 0.01 percent titanium is necessary to form a sufficient volume fraction of TiN particles to restrict austenite grain growth. Because strength may be reduced due to the secondary precipitation of VN on TiN, some compensation in strength may be required. A preferred method for compensating for reduced strength (and enhancing toughness) is by decreasing the sulfur level to less than about 0.005 percent, thereby allowing additional manganese to be in solution (i.e., not tied up as manganese sulfide). The additional manganese in solution can provide extra solid solution strengthening and further refinement of the ferrite grain size by lowering the transformation temperature. Nevertheless, the net effect of a titanium addition to this grade of steel is to improve toughness at a slight reduction in yield strength of about 2,000 psi.

In the third embodiment of the invention, the same composition as the first embodiment is used, except that the aluminum content is increased to from about 0.040 to about 0.070 percent. At these higher aluminum levels, the aluminum nitrides remain undissolved during reheating, thereby reducing the amount of nitrogen available for vanadium nitride precipitation strengthening. Fortunately, the aluminum nitride particles available at the reheat temperature and during hot rolling restrict austenite grain growth, resulting in a fine ferrite grain size upon transformation and significant grain size strengthening which largely compensates for the loss in vanadium nitride particle strengthening.

Small amounts of other elements are acceptable in the steel of the invention, and cannot be avoided in ordinary steelmaking practice. Nickel and chromium in amounts up to about 0.08 percent, and perhaps higher, may be present in the steel. Nickel has intentionally been added in some prior steels used for similar products, but it has been omitted in any significant level in the steel of the invention. Copper in the range of 0.10 percent is often present in steels, and is not detrimental to the steel of the invention.

Molybdenum is preferably maintained at a low level, below about 0.05 percent, as higher additions can contribute to reduced strength of the hot-rolled steel due to the promotion of the formation of brittle lower transformation products.

The following examples are presented to illustrate aspects of the invention, and should not be taken as limiting of the invention in any respect.

EXAMPLE 1

A 10 ton heat of steel was melted in air and ingot cast. The ingot was rolled to a 11¼ inch by 6½ inch cross section, cut into four lengths, and inspected. One of the blooms was discarded due to porosity. The three remaining blooms were reheated to 2300° F. and hot rolled to a channel section having a section depth of 10 inches, a flange width of 3½ inches, a flange thickness of ½ inch, and a web thickness of 5/16 inch.

The compositions of the channel sections prepared from the three blooms are 0.23–0.26 percent carbon, 1.58–1.71 percent manganese, 0.021–0.024 phosphorus, 0.004–0.006 percent sulfur, 0.49–0.50 percent silicon, 0.20 percent vanadium, 0.009–0.013 percent aluminum, 0.027–0.029 nitrogen, balance iron and minor amounts of impurities. The ranges indicated for some elements reflects variations between the three different blooms. While similar in some compositional respects, the steel of this Example 1 is not within the scope of the invention. The principal difference is the higher carbon content than permitted by the compositional ranges of the invention.

Mechanical properties of the flange and web regions of the channel sections were measured. The yield strengths were 94.6–101.5 ksi (thousands of pounds per square inch) and 100.5–107.5 ksi for the flange and web regions, respectively. The 15 foot pound Charpy V-notch transition temperature was from +50° to +100° F., and +125° F., for the flange and web sections, respectively. (The web value was inferred from the 10 foot pound transition temperature measured using ⅔ size Charpy specimens.) The 50% Fracture Appearance Transition Temperature (FATT) was about 250° F. for both the flange and the web regions. Using strain-and load-controlled tests, the fatigue strength at one million cycles was found to be 66.4 ksi.

The steel of Example 1 has sufficient yield strength, but the fracture properties are not acceptable for use in truck side rails.

EXAMPLE 2

Three steels were prepared by air induction melting and cast as 500 pound ingots. The 8¼inch square ingots were hot rolled to 4 inch by 5 inch billets, and then hot rolled after reheating to 2300° F. to plates of thickness of either 0.30 or 0.65 inches. The finish temperature for the 0.30 inch thick plate was 1700° F., and the finish temperature for the 0.65 inch thick plate was 1860° F. These section thicknesses were chosen to simulate the web and flange thicknesses of a channel section, respectively. The compositions are as follows:

TABLE I

| | Composition (weight percent) | | | | | | | |
|---|---|---|---|---|---|---|---|---|
| Code | C | Mn | Si | V | Al | N | P | S |
| 2-1 | .10 | 1.63 | .45 | .20 | .019 | .027 | .015 | .027 |
| 2-2 | .16 | 1.63 | .46 | .20 | .022 | .023 | .015 | .024 |
| 2-3 | .25 | 1.70 | .50 | .20 | .015 | .026 | .020 | .027 |

Code 2-2 steel is within the compositional range of the invention, while code 2-1 steel has a lower carbon content and code 2-3 has a higher carbon content.

Metallographic studies were performed on the hot rolled sections, with the following results:

TABLE II

| Code | Thickness (inch) | Ferrite Grain Size (micrometers) | Pearlite (vol. percent) |
|---|---|---|---|
| 2-1 | 0.30 | 5.5 | 10.9 |
| 2-1 | 0.65 | 9.3 | 12.0 |
| 2-2 | 0.30 | 4.0 | 24.4 |
| 2-2 | 0.65 | 5.6 | 26.6 |
| 2-3 | 0.30 | 3.6 | 41.2 |

TABLE II-continued

| Code | Thickness (inch) | Ferrite Grain Size (micrometers) | Pearlite (vol. percent) |
|---|---|---|---|
| 2-3 | 0.65 | 6.5 | 45.2 |

The fraction of pearlite changes significantly even though the carbon content changes by a relatively small amount.

The mechanical properties of the steels were measured in both thicknesses. The results are as follows:

TABLE III

| Code | Thickness (inch) | Yield Str. (ksi) | 10/15 ft-lb trans temp* (°F.) | 50% FATT (°F.) |
|---|---|---|---|---|
| 2-1 | 0.30 | 77.1 | −40 | +26 |
| 2-1 | 0.65 | 75.1 | +15 | +106 |
| 2-2 | 0.30 | 91.6 | −48 | +40 |
| 2-2 | 0.65 | 86.1 | +13 | +115 |
| 2-3 | 0.30 | 98.2 | +30 | +72 |
| 2-3 | 0.65 | 98.0 | +130 | +203 |

*For 0.30 inch specimens, the 10 ft-lb (foot pound) transition temperature of a ⅔ size Charpy V-notch specimen is reported, and for 0.65 inch specimens, the 15 ft-lb transition temperature of a full size Charpy V-notch specimen is reported The code 2-1 specimens have insufficient yield strength in both thicknesses, while the code 2-3 specimens have insufficient fracture toughness properties in both thicknesses. Only the code 2-2 specimens have sufficient yield strength and fracture toughness in both thicknesses. Using strain- and load-controlled tests, the fatigue strength of steel code 2-2 at 1 million cycles was 69.0 ksi.

EXAMPLE 3

Several steels were melted, cast, and hot rolled using the same procedure as reported for Example 2, the final section thickness was 0.45 inch, and the final hot rolling temperature was 1780° F.

The compositions of the steels were as follows:

TABLE IV

| Code | Composition (weight percent) | | | | | | | | |
|---|---|---|---|---|---|---|---|---|---|
| | C | Mn | Si | V | Al | N | P | S | Ti |
| 3-1 | .16 | 1.63 | .46 | .20 | .022 | .023 | .015 | .024 | — |
| 3-2 | .20 | 1.62 | .53 | .26 | .013 | .025 | .015 | .019 | — |
| 3-3 | .12 | 1.51 | .45 | .19 | .017 | .024 | .018 | .022 | — |
| 3-4 | .16 | 1.52 | .50 | .20 | .054 | .025 | .019 | .020 | — |
| 3-5* | .10 | 1.63 | .59 | .21 | .019 | .025 | .016 | .022 | — |
| 3-6 | .16 | 1.63 | .57 | .21 | .024 | .025 | .017 | .004 | .015 |
| 3-7* | .16 | 1.64 | .54 | .21 | .026 | .024 | .018 | .004 | .013 |
| 3-8* | .09 | 1.50 | .46 | .20 | .022 | .028 | .018 | .003 | .012 |
| 3-9 | .16 | 1.52 | .46 | .21 | .017 | .025 | .020 | .019 | .013 |

*Steel additionally had 0.28–0.30 percent molybdenum

Metallographic studies were performed on the hot rolled sections, with the following results:

TABLE V

| Code | Ferrite Grain Size (micrometers) | Pearlite (vol. pct) | Bain/Marten* (vol. pct) |
|---|---|---|---|
| 3-1 | 6.6 | 26.2 | — |
| 3-2 | 5.4 | 26.1 | — |
| 3-3 | 5.6 | 19.4 | — |
| 3-4 | 5.9 | 22.6 | — |
| 3-5 | 6.5 | — | 24.7 |
| 3-6 | 5.3 | 19.6 | 2.7 |
| 3-7 | 5.6 | — | 48.4 |
| 3-8 | 5.9 | — | 26.9 |

TABLE V-continued

| Code | Ferrite Grain Size (micrometers) | Pearlite (vol. pct) | Bain/Marten* (vol. pct) |
|---|---|---|---|
| 3-9 | 6.4 | 23.3 | — |

*Bainite/Martensite

The mechanical properties of the steels were measured, with the following results:

TABLE VI

| Code | Yield Str. (ksi) | CVN, 32 F* (ft-lb) | 15 ft-lb TT (°F.) | 50% FATT (°F.) |
|---|---|---|---|---|
| 3-1 | 86.8 | 17 | +15 | 130 |
| 3-2 | 87.9 | 26 | −35 | 75 |
| 3-3 | 76.6 | 20 | +5 | 70 |
| 3-4 | 84.9 | 40 | −45 | 60 |
| 3-5 | 62.1 | 31 | −40 | 70 |
| 3-6 | 86.6 | 49 | −10 | 90 |
| 3-7 | 71.7 | 44 | −50 | 65 |
| 3-8 | 63.0 | 50 | −80 | 65 |
| 3-9 | 83.4 | 20 | −10 | 115 |

*Charpy V-Notch Energy at 32° F.

Three steels having a low carbon content, codes 3-3, 3-5, and 3-8, had insufficient yield strength. Molybdenum additions did not cure this insufficiency, as seen for steels code 3-5 and 3-8. A steel with a carbon content within the range of the invention, but with added titanium and molybdenum, code 3-7, had insufficient yield strength. A steel with a high aluminum content, code 3-4, was acceptable, as were steels with added titanium, codes 3-6 and 3-9.

A comparison of the steels of Examples 1–3 demonstrates that a steel having a carbon content below about 0.16 percent has insufficient strength, while a steel above about 0.20 percent carbon, has insufficient toughness, for side rail applications.

EXAMPLE 4

Steels 3-1, 3-2, 3-4, and 3-6 were prepared as described in Example 3, except that reheating temperatures (prior to hot rolling) of 2100° F., 2200° F., and 2300° F. were utilized for different samples. The hot rolling finishing temperatures were 1580° F., 1680° F., and 1780° F., respectively. Lower reheating temperatures, below 2100° F., are not desirable because too much nitrogen may be out of solution as aluminum nitride during hot rolling.

The mechanical properties of the steels were measured, with the following results:

TABLE VII

| Code | Reheat (F) | YS (ksi) | CVN, 32 F* (ft-lb) | 15 ft-lb TT (°F.) | 50% FATT (°F.) |
|---|---|---|---|---|---|
| 3-1 | 2300 | 86.8 | 14 | +32 | 150 |
| 3-1 | 2200 | 89.1 | 34 | −50 | 40 |
| 3-1 | 2100 | 87.6 | 55 | −100 | −20 |
| 3-2 | 2300 | 87.9 | 26 | −35 | 75 |
| 3-2 | 2200 | 84.9 | 36 | −55 | 25 |
| 3-2 | 2100 | 91.2 | 38 | −75 | 10 |
| 3-4 | 2300 | 84.9 | 40 | −45 | 60 |
| 3-4 | 2200 | 80.8 | 34 | −75 | 55 |
| 3-4 | 2100 | 82.6 | 41 | −85 | 20 |
| 3-6 | 2300 | 86.6 | 49 | −10 | 90 |
| 3-6 | 2200 | 80.8 | 60 | −55 | 70 |
| 3-6 | 2100 | 82.6 | 51 | −85 | 50 |

*Charpy V-Notch toughness, at a temperature of 32 F.

Figure 2:
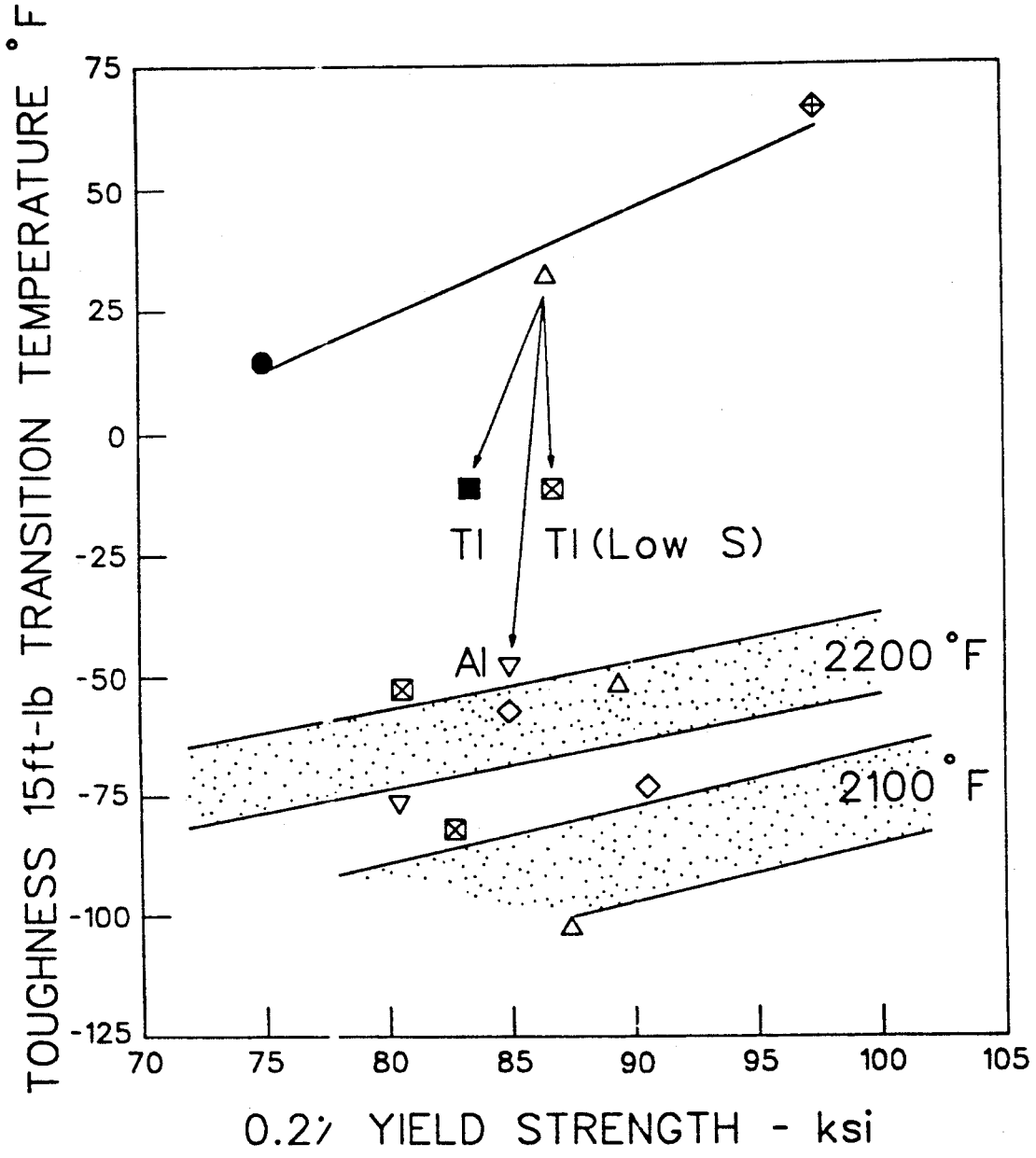
FIG. 2 is a graph of Toughness as a function of Yield Strength, for several steels hot rolled after reheating to temperatures of 2100° F., 2200° F., or 2300° F.

These results indicate that the lower reheating and finishing temperatures are favored. In general, the reduction in reheating temperature produces an improvement in the strength/toughness balance, as depicted in FIG. 2. The 15 ft-lb transition temperature (TT) of the steels without titanium and large aluminum additions reheated to 2300° F. is empirically related to the yield strength (YS in ksi) of the steels by the relation $$TT = 2.1(YS) - 145$$

and the steels heated to a lower reheat temperature follow similar relations. Steels in the prior art generally fall above the line expressed by this relation. The further improvement attained by titanium and larger aluminum additions is indicated by the arrows.

In FIG. 2, the properties resulting from the same exemplary samples are grouped by reheat temperature. For the 2300° F. reheat temperature, the arrows indicate the general direction of property changes that produce substantially improved toughness with a slight loss in strength. While lower reheat temperatures generally provide a better combination of strength and toughness, in some compositions a reduction in reheat temperature may significantly reduce strength. Therefore, the selection of a steel composition within the broad ranges of the invention will depend upon the exact balance of strength and toughness required.

More specifically, for the base V-N steel code 3-1, a 2100° F. reheat temperature clearly produces the best properties. However, for the V-N-Ti steel code 3-6 and the V-N-Al steel code 3-4, the optimum reheat temperature depends upon the balance of mechanical properties required. The lower reheat temperature produces better toughness but lower strength. The designer can use the data of FIG. 2 to select particular compositions and treatments that will yield suitable results for a selected product application.

The steel of the invention provides an optimized microalloyed steel composition that meets standards for yield strength and toughness for truck side rail applications, in a hot rolled steel. Reaching the required properties in a hot rolled steel greatly reduces the cost of the side rails and other products made from the steel, because cold forming and heat treatments are not required.

Although particular embodiments of the invention have been described in detail for purposes of illustration, various modifications may be made without departing from the spirit and scope of the invention. Accordingly, the invention is not to be limited except as by the appended claims.

What is claimed is:

1. A steel, consisting essentially of from about 0.16 to about 0.20 percent carbon, from about 1.2 to about 2.0 percent manganese, from about 0.45 to about 0.55 percent silicon, from about 0.18 to about 0.22 percent vanadium, from about 0.001 to about 0.030 percent aluminum, from about 0.023 to about 0.027 percent nitrogen, less than about 0.030 percent phosphorus, less than about 0.030 percent sulfur, balance iron, with all percentages by weight.

2. The steel of claim 1, containing about 0.18 percent carbon, about 1.6 percent manganese, about 0.50 percent silicon, about 0.20 percent vanadium, about 0.020 percent aluminum, about 0.025 percent nitrogen, about 0.020 percent phosphorus, and about 0.025 percent sulfur.

3. A steel, consisting essentially of from about 0.16 to about 0.20 percent carbon, from about 1.2 to about 2.0 percent manganese, from about 0.45 to about 0.55 percent silicon, from about 0.10 to about 0.30 percent vanadium, from about 0.001 to about 0.030 percent aluminum, from about 0.010 to about 0.027 percent nitrogen, less than about 0.030 percent phosphorus, less than about 0.005 percent sulfur, from about 0.010 to about 0.020 percent titanium, balance iron, with all percentages by weight.

4. The steel of claim 3, containing from about 1.5 to about 1.7 percent manganese.

5. The steel of claim 3, containing about 0.18 percent carbon, about 1.6 percent manganese, about 0.50 percent silicon, about 0.20 percent vanadium, about 0.020 percent aluminum, about 0.025 percent nitrogen, about 0.015 titanium, about 0.020 percent phosphorus, and about 0.002 percent sulfur.

6. A steel, consisting essentially of from about 0.16 to about 0.20 percent carbon, from about 1.2 to about 2.0 percent manganese, from about 0.45 to about 0.55 percent silicon, from about 0.18 to about 0.22 percent vanadium, from about 0.040 to about 0.070 percent aluminum, from about 0.023 to about 0.027 percent nitrogen, less than about 0.030 percent phosphorus, less than about 0.030 percent sulfur, balance iron, with all percentages by weight.

7. The steel of claim 6, containing about 0.18 percent carbon, about 1.6 percent manganese, about 0.50 percent silicon, about 0.20 percent vanadium, about 0.055 percent aluminum, about 0.025 percent nitrogen, about 0.020 percent phosphorus, and about 0.025 percent sulfur.

8. A steel article prepared by a process comprising the steps of furnishing a piece of steel having the composition consisting essentially of from about 0.16 to about 0.20 percent carbon, from about 1.2 to about 2.0 percent manganese, from about 0.45 to about 0.55 percent silicon, from about 0.10 to about 0.30 percent vanadium, from about 0.001 to about 0.030 percent aluminum, from about 0.010 to about 0.027 percent nitrogen, less than about 0.030 percent phosphorus, less than about 0.030 percent sulfur, balance iron, with all percentages by weight;

heating the piece of steel into its hot rolling temperature range; and hot rolling the steel to a structural section of variable thickness, there being no heat treatment subsequent to the step of hot rolling.

9. The article of claim 8, wherein the steel is heated to a minimum temperature of about 2100° F. in the step of heating.

10. The article of claim 8, wherein the reduced section is a C-shaped channel with the web having a different thickness than the flanges.

11. A steel article prepared by a process comprising the steps of furnishing a piece of steel having the composition set forth in claim 3, heating the piece of steel into its hot rolling temperature range; and hot rolling the steel to a structural section of variable thickness.

12. The article of claim 11, wherein the steel is heated to a minimum temperature of about 2100° F. in the step of heating.

13. The article of claim 11, wherein the reduced section is a C-shaped channel with the web having a different thickness than the flanges.

14. A steel article prepared by a process comprising the steps of furnishing a piece of steel having the composition consisting essentially of from about 0.16 to about 0.20 percent carbon, from about 1.2 to about 2.0 percent manganese, from about 0.45 to about 0.55 percent silicon, from about 0.10 to about 0.30 percent vanadium, from about 0.040 to about 0.070 percent aluminum, from about 0.010 to about 0.027 percent nitrogen, less than about 0.030 percent phosphorus, less than about 0.030 percent sulfur, balance iron, with all percentages by weight;

heating the piece of steel into its hot rolling temperature range; and hot rolling the steel to a structural section of variable thickness, there being no heat treatment subsequent to the step of hot rolling.

15. The article of claim 14, wherein the steel is heated to a minimum temperature of about 2100° F. in the step of heating.

16. The article of claim 14, wherein the reduced section is a C-shaped channel with the web having a different thickness than the flanges.

17. The article of claim 8, wherein the steel contains from about 1.5 to about 1.7 percent manganese, from about 0.18 to about 0.22 percent vanadium, and from about 0.023 to about 0.027 percent nitrogen.

18. The article of claim 14, wherein the steel contains from about 1.5 to about 1.7 percent manganese, from about 0.18 to about 0.22 percent vanadium, and from about 0.023 to about 0.027 percent nitrogen.

* * * * *